US011903450B1

(12) United States Patent
Del Rio

(10) Patent No.: US 11,903,450 B1
(45) Date of Patent: Feb. 20, 2024

(54) SELECTIVELY HEIGHT ADJUSTABLE PLATFORM SHOE ASSEMBLY AND METHOD OF USE

(71) Applicant: Esbeyda Del Rio, Los Angeles, CA (US)

(72) Inventor: Esbeyda Del Rio, Los Angeles, CA (US)

( * ) Notice: Subject to any disclaimer, the term of this patent is extended or adjusted under 35 U.S.C. 154(b) by 0 days.

(21) Appl. No.: 17/964,886

(22) Filed: Oct. 12, 2022

(51) Int. Cl.
*A43B 7/38* (2006.01)
*A43B 3/24* (2006.01)

(52) U.S. Cl.
CPC ..... *A43B 7/38* (2013.01); *A43B 3/246* (2013.01)

(58) Field of Classification Search
CPC ..... A43B 7/38; A43B 3/246; A43B 21/437; A43B 21/42
See application file for complete search history.

(56) References Cited

U.S. PATENT DOCUMENTS

| | | | | |
|---|---|---|---|---|
| 5,732,481 | A | 3/1998 | Farhad | |
| 7,552,021 | B2 | 6/2009 | Bar-Haim | |
| 8,453,351 | B1 | 6/2013 | Hale | |
| 11,197,516 | B2 | 12/2021 | Chiang | |
| D943,973 | S | 2/2022 | Kosenick | |
| 2013/0219745 | A1* | 8/2013 | Moreno-Collado | A43B 3/38 36/44 |
| 2015/0157087 | A1* | 6/2015 | Blumenthal | A43B 3/34 36/100 |
| 2016/0023050 | A1 | 1/2016 | Perez | |
| 2016/0235161 | A1 | 8/2016 | Edwin | |
| 2016/0309833 | A1* | 10/2016 | Beaufort | A43B 3/24 |
| 2020/0337415 | A1* | 10/2020 | Chen | A43B 21/437 |
| 2023/0148703 | A1* | 5/2023 | Regelskis | A43B 3/34 36/1 |

FOREIGN PATENT DOCUMENTS

| | | |
|---|---|---|
| WO | WO2008068738 | 6/2008 |

* cited by examiner

*Primary Examiner* — Ted Kavanaugh

(57) ABSTRACT

A selectively height adjustable platform shoe assembly for increasing perceived height and actual reach of a user includes a pair of articles of footwear, each comprising a sole to which an upper is attached. The upper and the sole define a cavity, into which a respective foot of a user is insertable. A recess extends into a lower face of the sole and from proximate to a first end and second ends of the sole. A plurality of nested rings is attached to the sole and is positioned in the recess. An actuator is attached to the sole, is operationally engaged to the plurality of nested rings, and can selectively extend the nested rings from the recess. A controller is attached to the sole and is operationally engaged to the actuator. The controller is enabled to selectively actuate the actuator to extend the nested rings from the recess.

15 Claims, 9 Drawing Sheets

SELECTIVELY HEIGHT ADJUSTABLE PLATFORM SHOE ASSEMBLY AND METHOD OF USE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to platform shoe assemblies and more particularly pertains to a new platform shoe assembly for increasing perceived height and actual reach of a user. The present invention discloses a platform shoe assembly that allows a person of short stature to appear taller or to reach items that otherwise would be out of reach.

(2) Description of Related Art Including Information Disclosed Under 37 CFR 1.97 and 1.98

The prior art relates to platform shoe assemblies, which may comprise shoes have heels that are height adjustable and adjustable height platforms that are attachable to shoes. Related prior art comprises inserts for footwear that raise heels of a user within the footwear and dynamically adjustable plates to which shoes are attachable to correct altered gates. What is lacking in the prior art is a platform shoe assembly comprising a pair of articles of footwear wherein each sole has a recess from which a plurality of rings is selectively extensible for increasing an effective height of a user.

BRIEF SUMMARY OF THE INVENTION

An embodiment of the disclosure meets the needs presented above by generally comprising a pair of articles of footwear. Each article of footwear comprises a sole and an upper. The upper is attached to a top perimeter of the sole so that the upper and the sole define a cavity, which is configured for insertion of a respective foot of a user. A recess extends into a lower face of the sole and from proximate to a first end to proximate to a second end of the sole. A plurality of nested rings is attached to the sole and is positioned in the recess. An actuator is attached to the sole, is operationally engaged to the plurality of nested rings, and is configured to selectively extend the nested rings from the recess. A controller is attached to the sole and is operationally engaged to the actuator. The controller is enabled to selectively actuate the actuator to extend the nested rings from the recess. The nested rings thus are configured to elevate the user from a surface upon which the user is standing or walking.

Another embodiment of the disclosure includes a method of increasing perceived height and actual reach of a user. The method comprises a first step of providing a selectively height adjustable platform shoe assembly according to the disclosure above.

A second step of the method is donning the footwear. A third step of the method is manipulating the controller to actuate the actuator so that the nested rings are extended from the recess.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
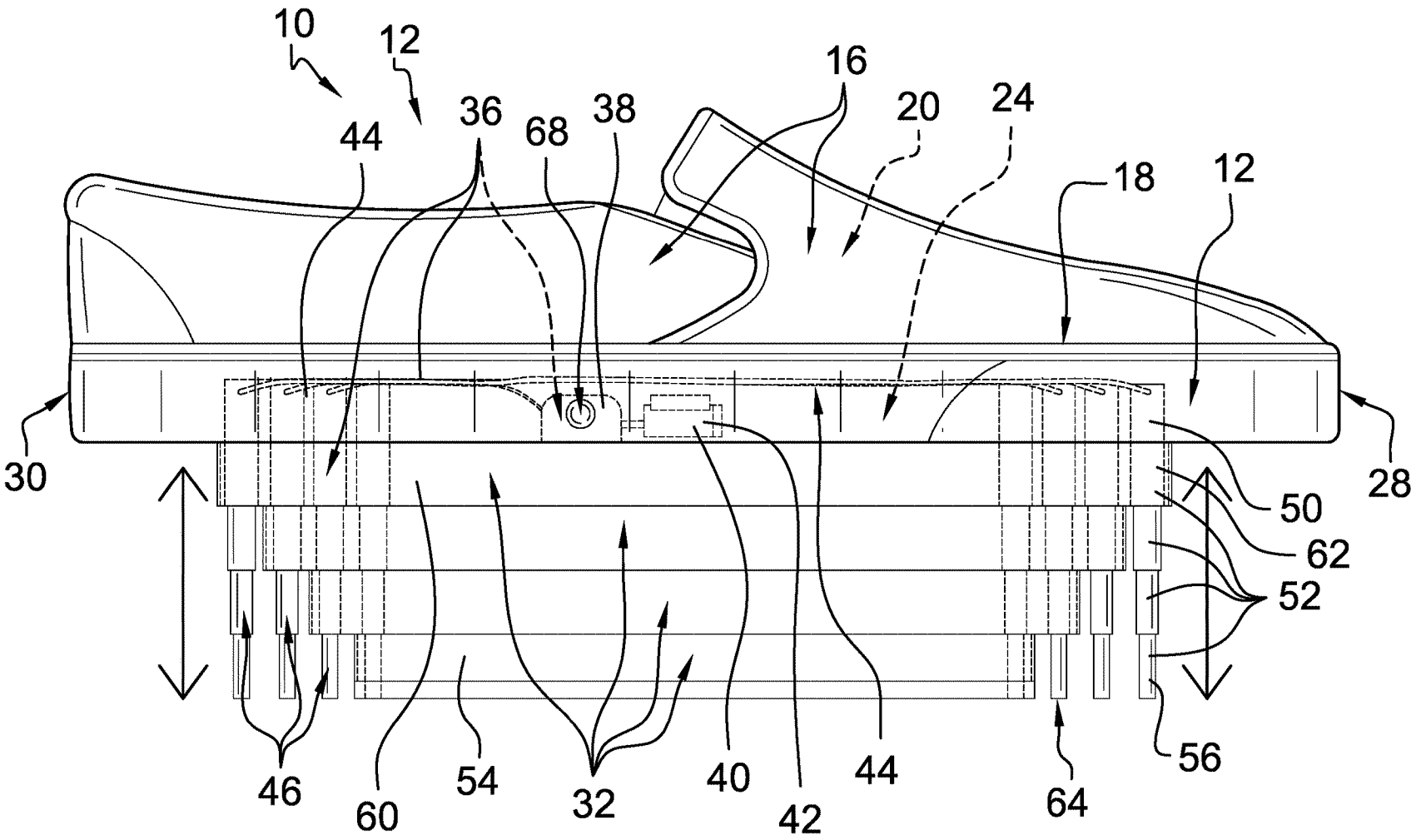
FIG. 1 is a first side view of a selectively height adjustable platform shoe assembly according to an embodiment of the disclosure.
Figure 2:
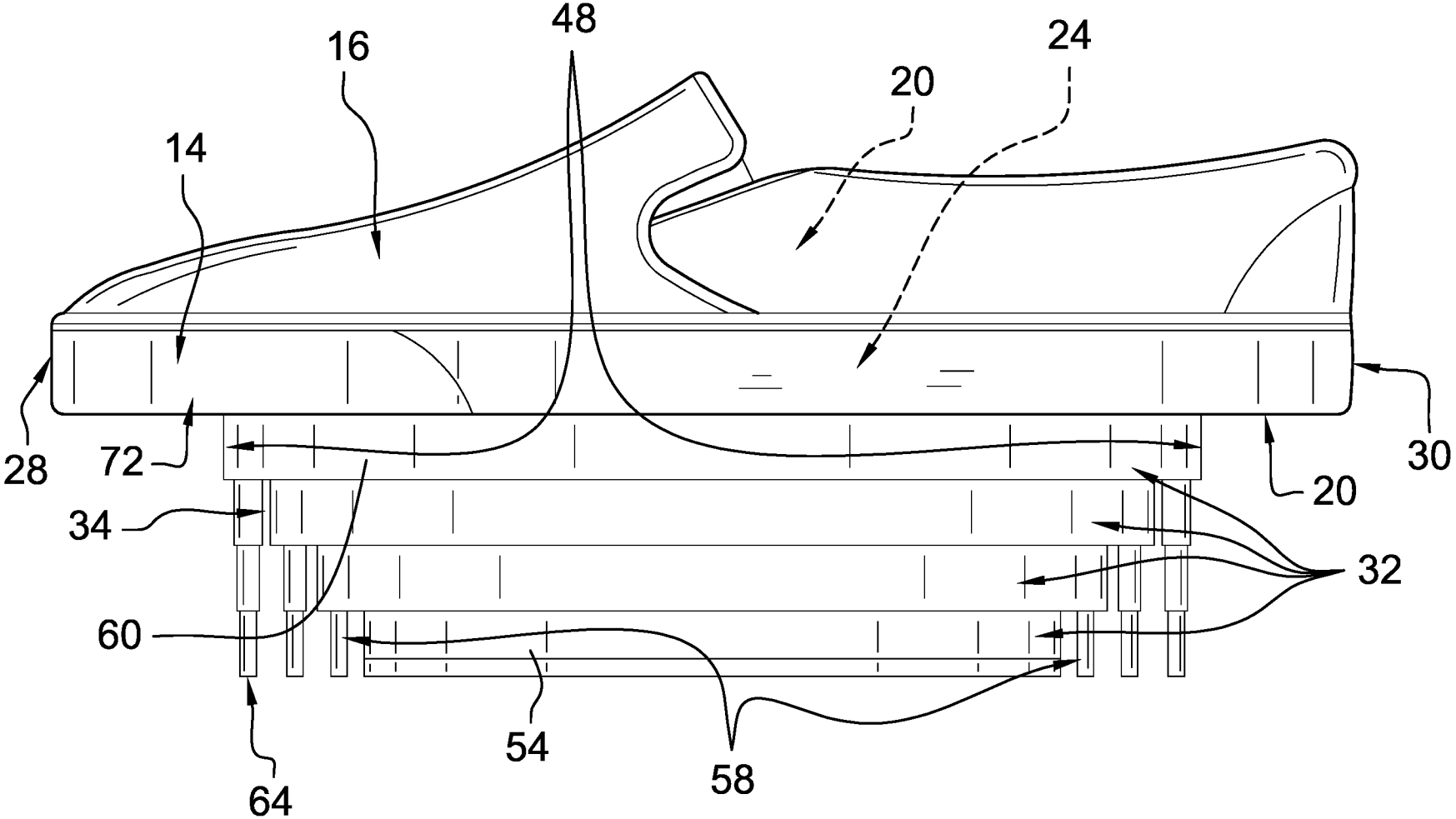
FIG. 2 is a second side view of an embodiment of the disclosure.
Figure 3:
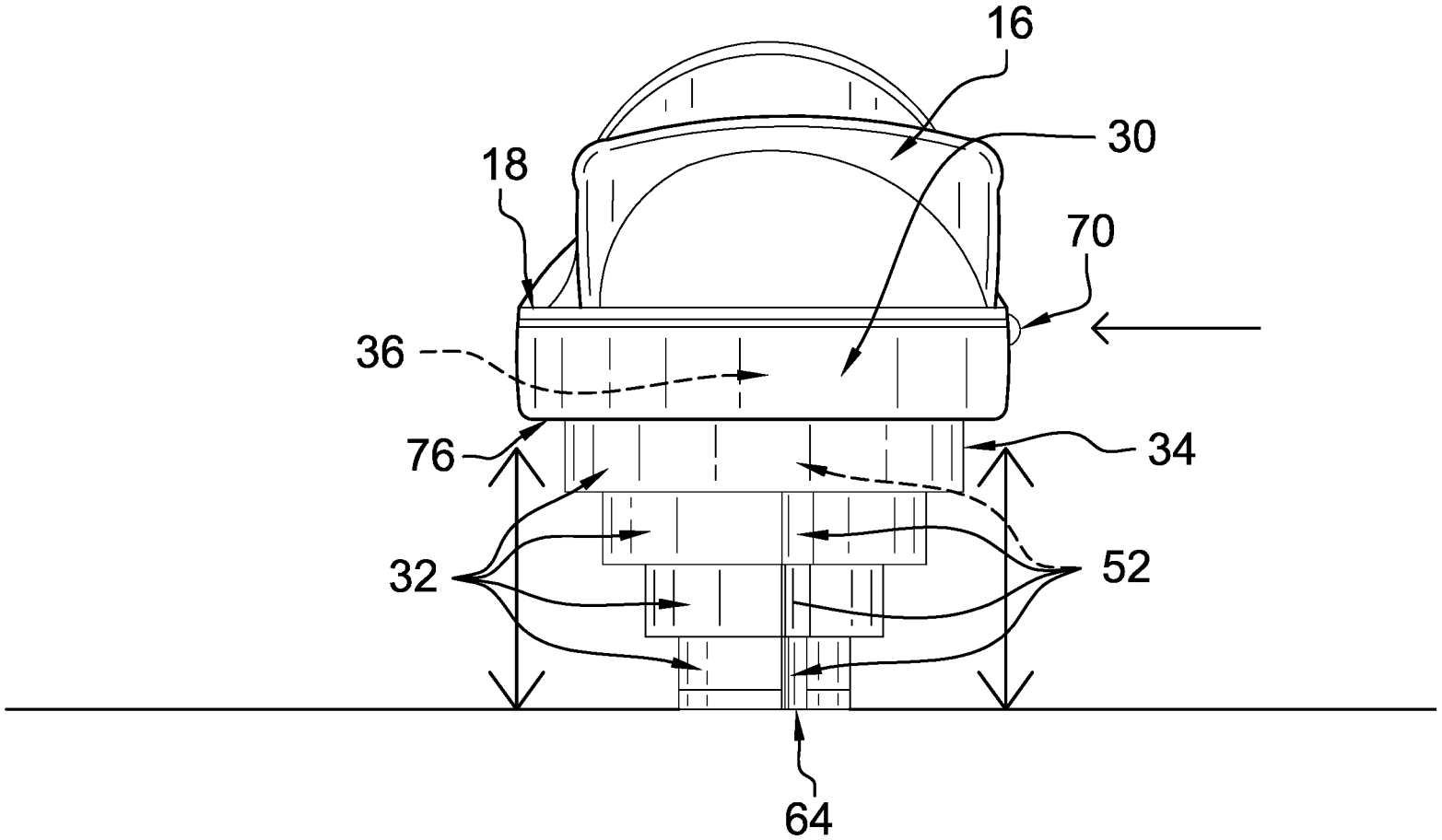
FIG. 3 is a rear view of an embodiment of the disclosure.
Figure 4:
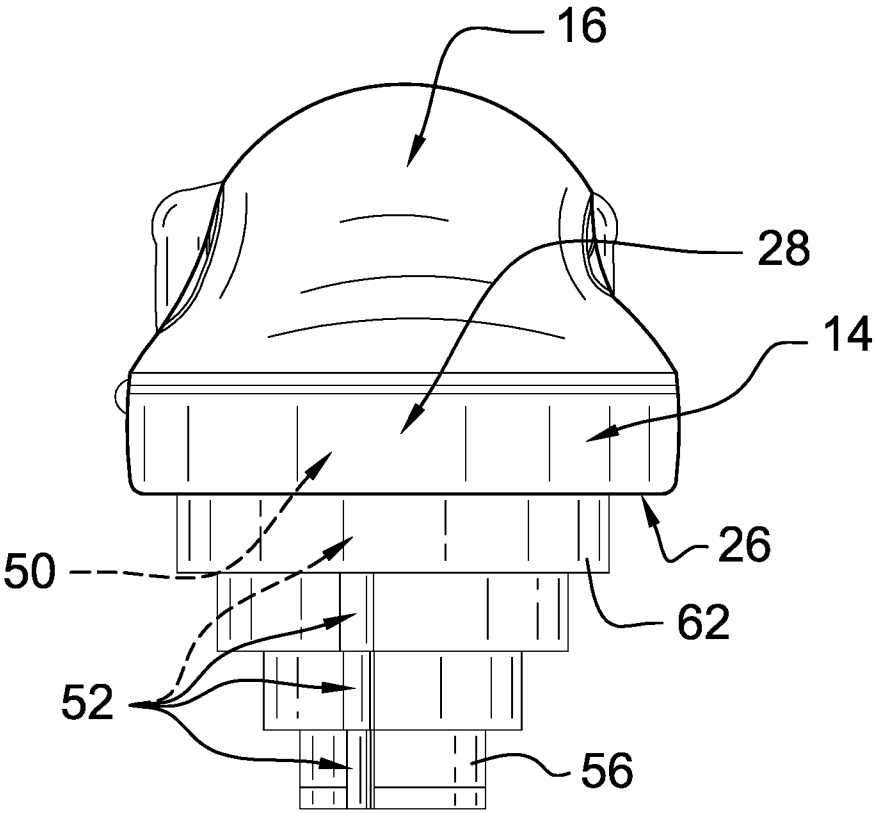
FIG. 4 is a front view of an embodiment of the disclosure.
Figure 5:
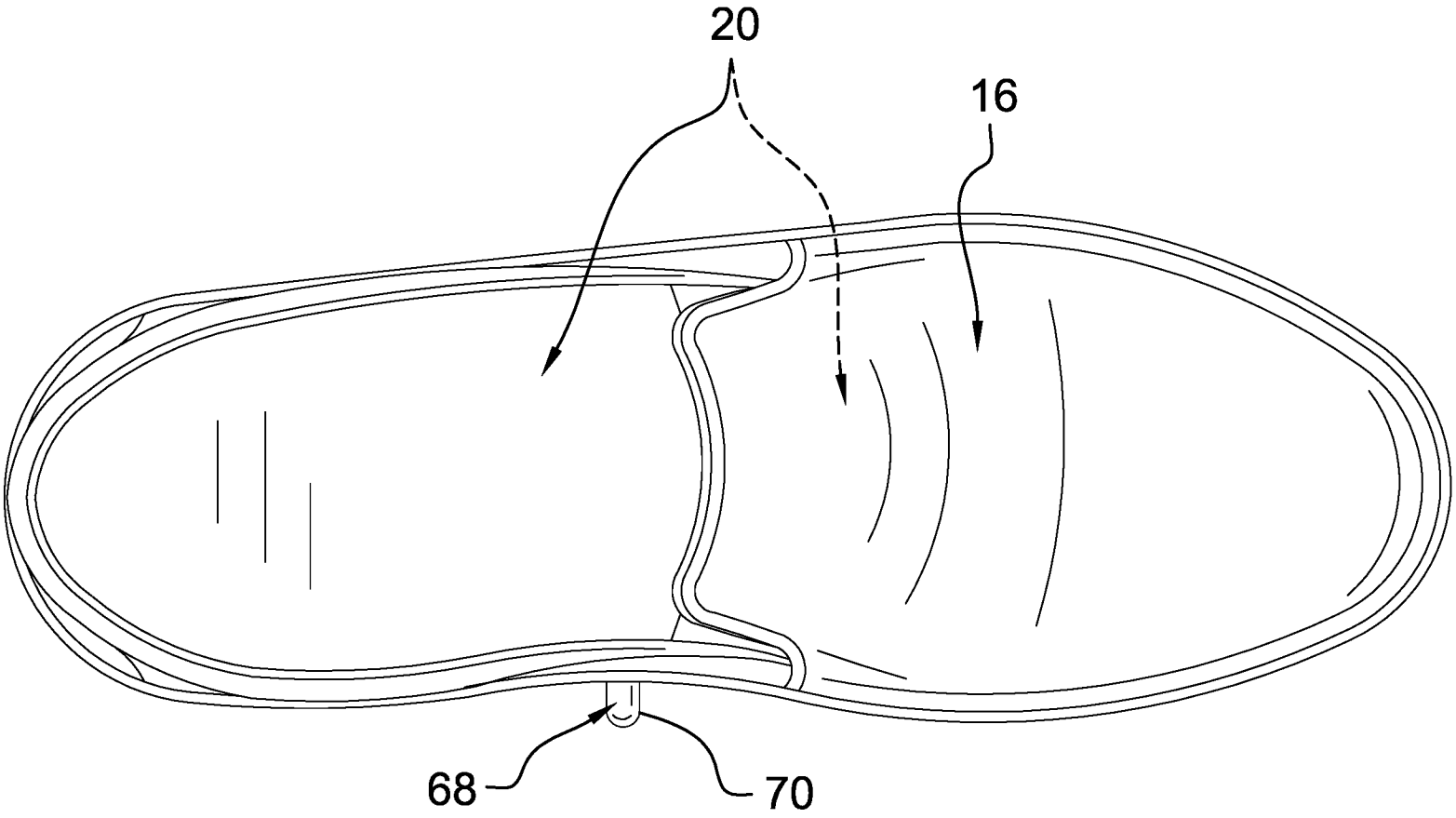
FIG. 5 is a top view of an embodiment of the disclosure.

With reference now to the drawings, and in particular to FIGS. 1 through 9 thereof, a new platform shoe assembly embodying the principles and concepts of an embodiment of the disclosure and generally designated by the reference numeral 10 will be described.

As best illustrated in FIGS. 1 through 9, the selectively height adjustable platform shoe assembly 10 generally comprises a pair of articles of footwear 12. Each article of footwear 12 comprises a sole 14 and an upper 16. The upper 16 is attached to a top perimeter 18 of the sole 14 so that the upper 16 and the sole 14 define a cavity 20, 20 which is configured for insertion of a respective foot of a user. The pair of articles of footwear 12 may be configured as a pair of shoes 22, a pair of boots, a pair of sandals, a pair of slippers, or the like.

Figure 6:
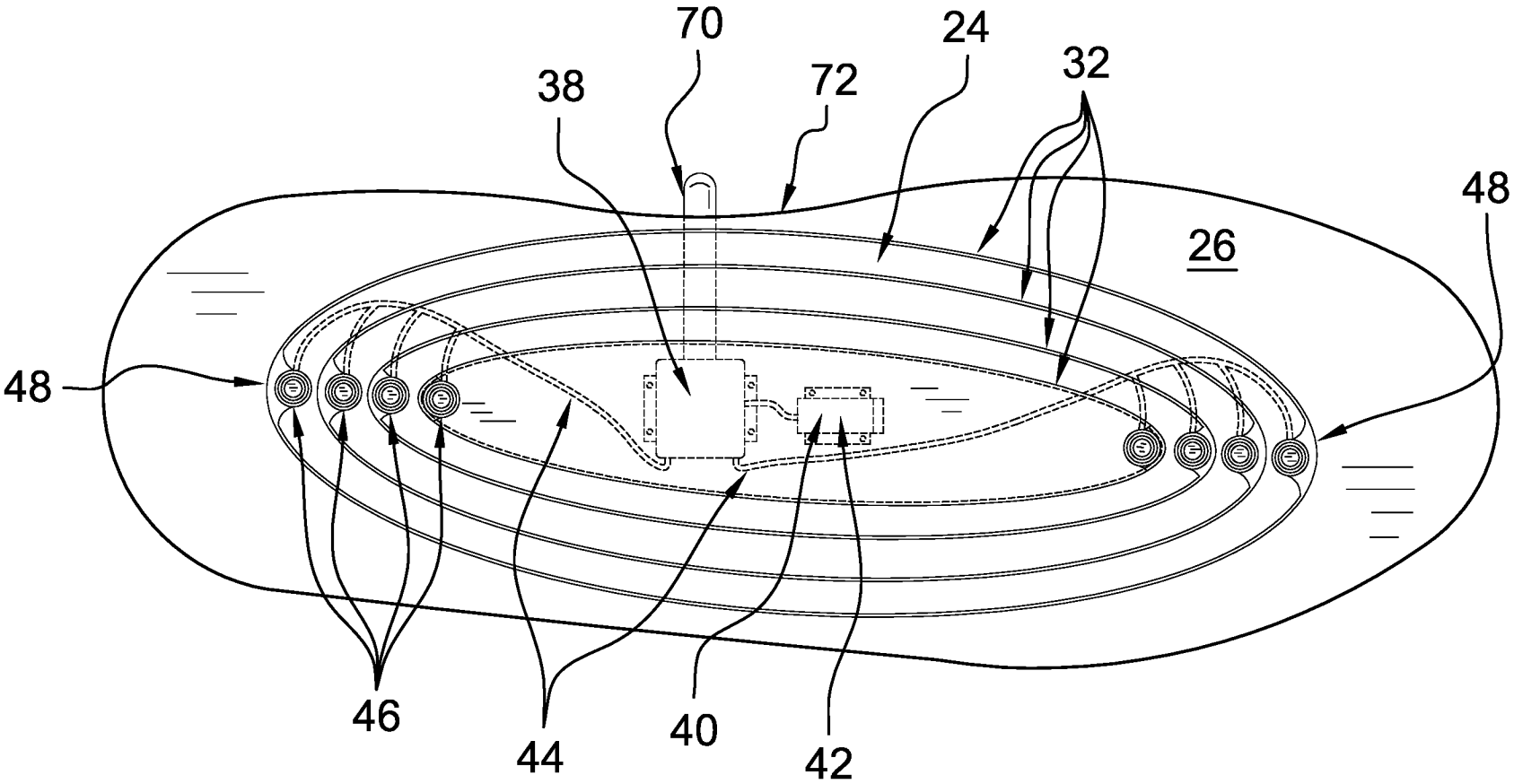
FIG. 6 is a bottom view of an embodiment of the disclosure.

A recess 24 extends into a lower face 26 of the sole 14 and from proximate to a 25 first end 28 to proximate to a second end 30 of the sole 14. As shown in FIG. 6, the recess 24 is substantially elliptical. The present invention also anticipates the recess 24 being alternatively shaped, such as, but not limited to, rectangular, shaped complementarily to the sole 14, or the like.

A plurality of nested rings 32 is attached to the sole 14 and is positioned in the recess 24. The plurality of nested rings 32 comprises from two to six nested rings 32. The plurality of nested rings 32 may comprise from three to five nested rings 32. As shown in FIG. 6, the plurality of nested rings 32 may comprise four nested rings 32. Each nested ring 32 has a height 34 of 1.00 to 4.00 cm. Each nested ring 32 may have a height 34 of 2.00 to 3.00 cm. Each nested ring 32 may have a height 34 of 2.50 to 2.60 cm.

An actuator 36 is attached to the sole 14, is operationally engaged to the plurality of nested rings 32, and is configured to selectively extend the nested rings 32 from the recess 24. The actuator 36 may comprise a pump 38, which is in fluidic communication with a reservoir 40 containing hydraulic fluid 42. A plurality of hydraulic lines 44 is attached to and extends between the pump 38 and a plurality of hydraulic cylinders 46 so that each hydraulic cylinder 46 is in fluidic communication with the pump 38. The plurality of hydraulic cylinders 46 may comprise hydraulic cylinders 46 positioned singly at each opposed end 48 of each nested ring 32, as shown in FIG. 6.

Each hydraulic cylinder 46 comprises a fixed section 50 and a plurality of movable sections 52, with the plurality of movable sections 52 being numerically equivalent to the plurality of nested rings 32. Each nested ring 32 of the plurality of nested rings 32 is attached to associated movable sections 52 of associated hydraulic cylinders 46 so that the nested rings 32 are sequentially extended from the recess 24 as the plurality of hydraulic cylinders 46 is extended from the recess 24. One such configuration is shown in FIG. 1, wherein an innermost one of the nested rings 54 is attached to the last extended movable sections 56 of an associated pair of hydraulic cylinders 58. Similarly, an outmost one of the nested rings 60 is attached to the first extended movable sections 62 of another associated pair of hydraulic cylinders 58.

Termini 64 of the hydraulic cylinders 46 are substantially coplanar with whichever nested ring 32 is furthest from the sole 14, thereby increasing stability of the user wearing the footwear 12. The present invention also anticipates additional hydraulic cylinders 46 being attached to the plurality of nested rings 32. For example, hydraulic cylinders 46 could be attached singly to each opposed side 66 of each nested ring 32, further increasing the stability of the user.

A controller 68 is attached to the sole 14 and is operationally engaged to the actuator 36. The controller 68 is enabled to selectively actuate the actuator 36 to extend the nested rings 32 from the recess 24. The nested rings 32 thus are configured to elevate the user from a surface upon which the user is standing or walking. The present invention is anticipated to be useful to users who are shorter in stature and who would like to appear taller, or who would like to be able to selectively increase their height to reach items that would otherwise be out of reach.

The controller 68 may comprise a stem 70, which is attached to the pump 38 and which extends through a sidewall 72 of the sole 14, as shown in FIG. 6. The stem 70 is configured to be sequentially depressed toward the sidewall 72 to actuate the pump 38 to pump the hydraulic fluid 42 through the hydraulic lines 44 to extend the nested rings 32 from the recess 24. The present invention also anticipates the pump 38 being motor driven and the controller 68 acting wirelessly to actuate the motor.

Figure 7:
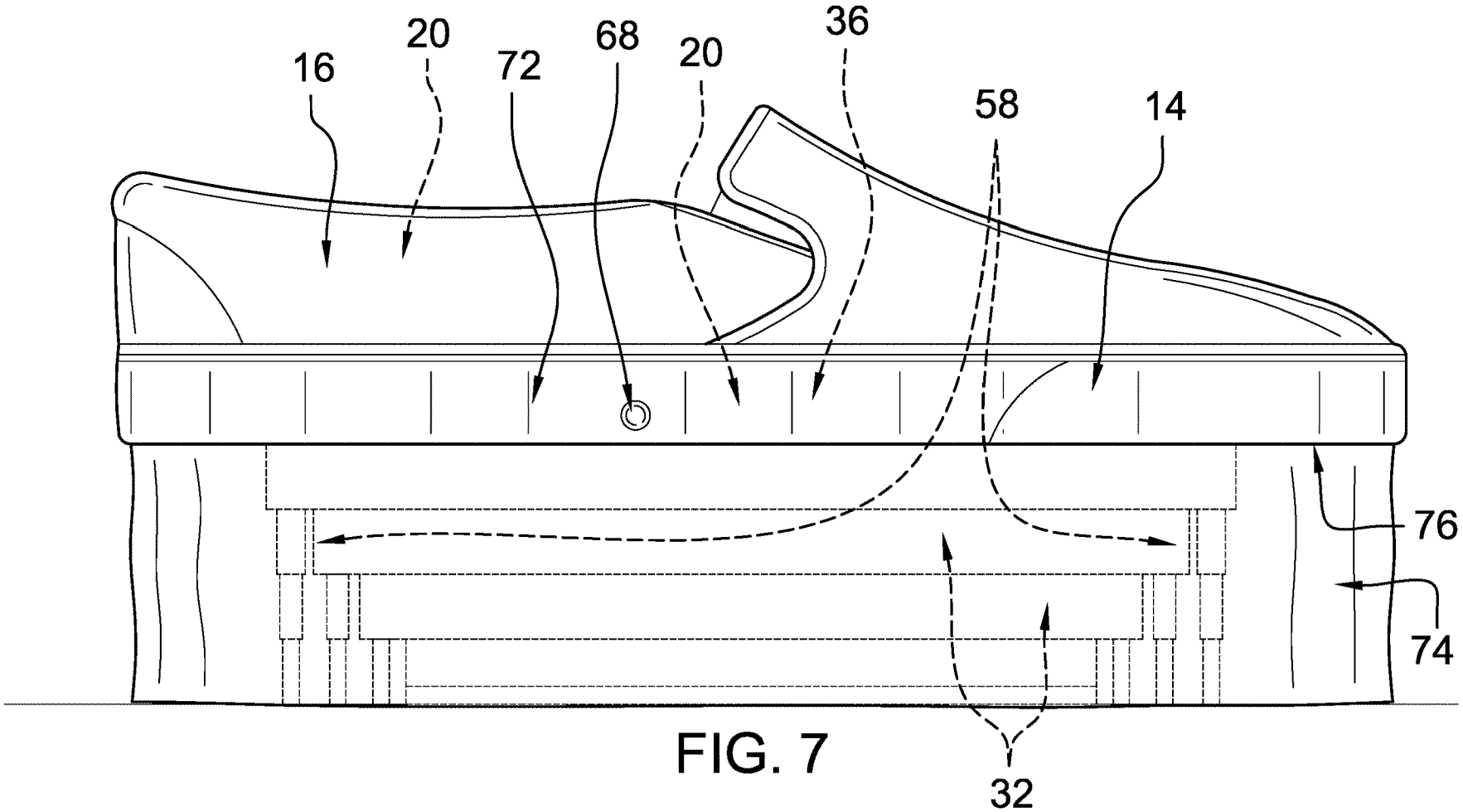
FIG. 7 is a first side view of an embodiment of the disclosure.
Figure 8:
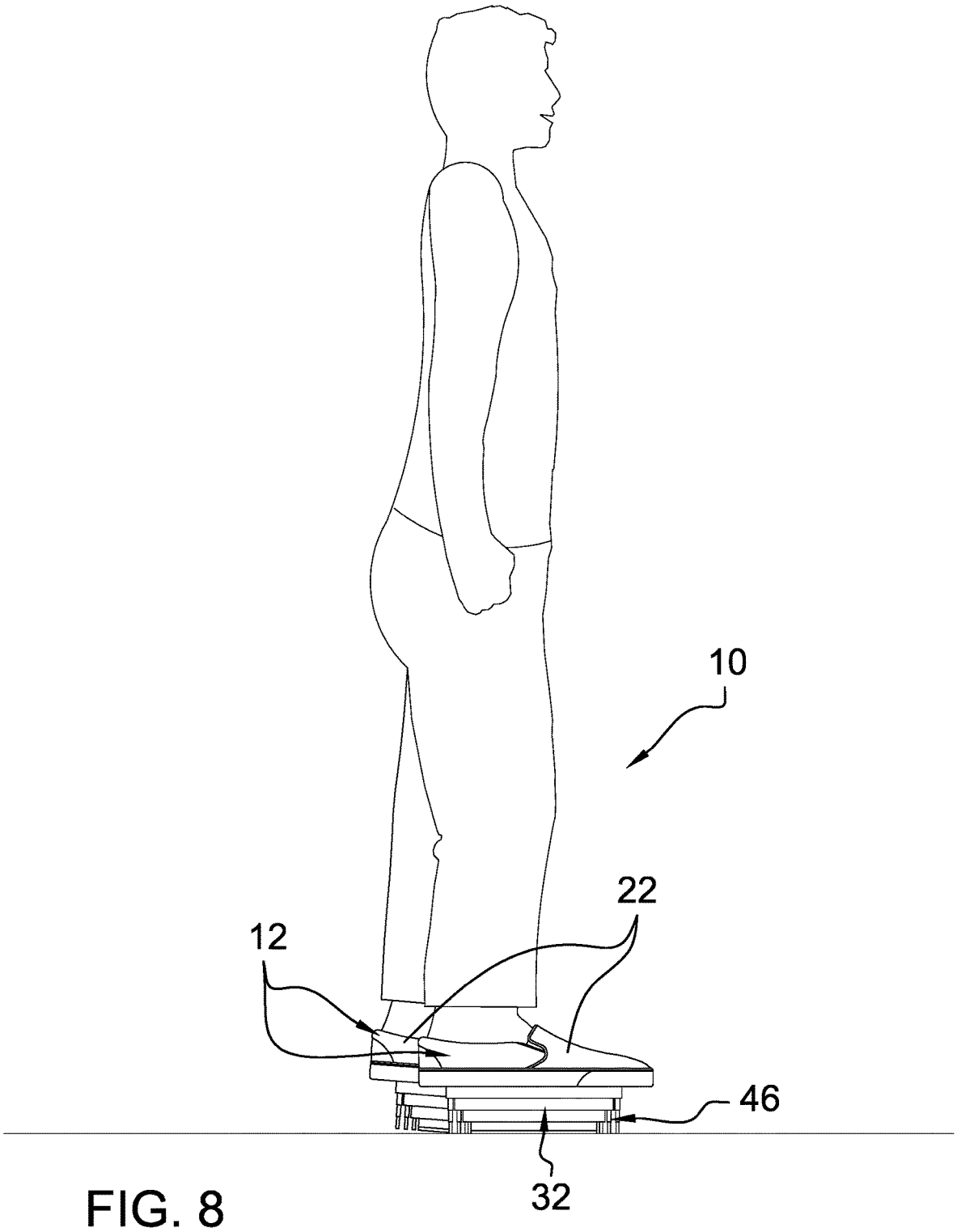
FIG. 8 is an in-use view of an embodiment of the disclosure.
Figure 9:
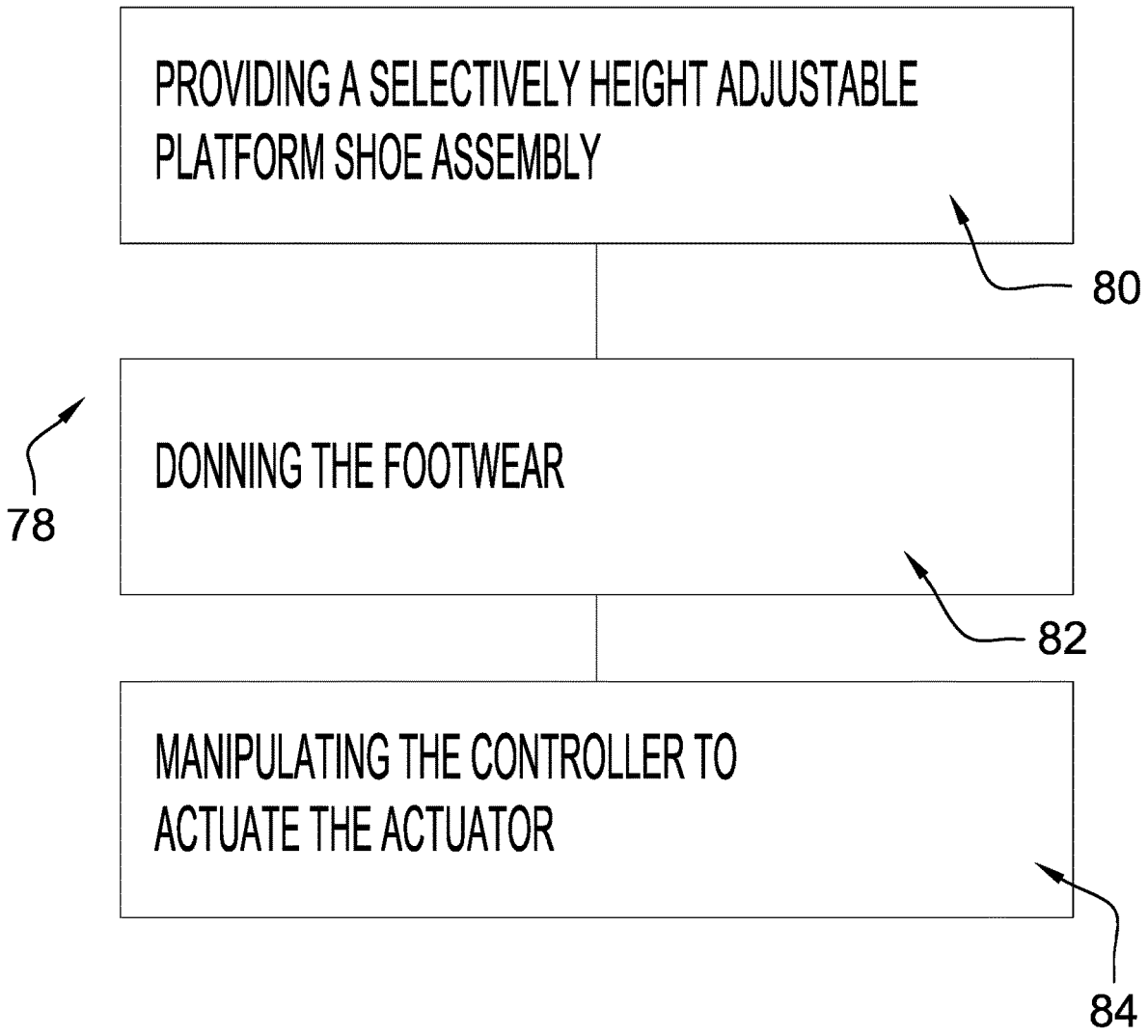
FIG. 9 is a flow diagram for a method utilizing an embodiment of the disclosure.

The selectively height adjustable platform shoe assembly 10 also may comprise a panel 74, which is attached to and which extends from a bottom perimeter 76 of the sole 14, as shown in FIG. 7. The panel 74 comprises fabric, elastomer, or the like and thus is flexible so that the panel 74 drapes from the sole 14 to the surface. The panel 74 is configured to shield the nested rings 32 and the hydraulic cylinders 46 from view by a person who is proximate to the user.

In use, the selectively height adjustable platform shoe assembly enables a method of increasing perceived height and actual reach of a user 78. The method comprises a first step 80 of providing a selectively height adjustable platform shoe assembly 10 according to the specification above. A second step 82 of the method 78 is donning the footwear 12. A third step 84 of the method 78 is manipulating the controller 68 to actuate the actuator 36 so that the nested rings 32 are extended from the recess 24.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A selectively height adjustable platform shoe assembly comprising a pair of articles of footwear, each article of footwear comprising:

a sole;

an upper attached to a top perimeter of the sole, such that the upper and the sole define a cavity configured for insertion of a respective foot of a user;

a recess extending into a lower face of the sole, the recess extending from proximate to a first end to proximate to a second end of the sole;

a plurality of nested rings attached to the sole and positioned in the recess;

an actuator attached to the sole, operationally engaged to the plurality of nested rings, and being configured for selectively extending the nested rings from the recess; and a controller attached to the sole and operationally engaged to the actuator, such that the controller is enabled for selectively actuating the actuator for extending the nested rings from the recess, wherein the nested rings are configured for elevating the user from a surface upon which the user is standing or walking.

2. The selectively height adjustable platform shoe assembly of claim 1, wherein the recess is substantially elliptical.

3. The selectively height adjustable platform shoe assembly of claim 1, wherein the plurality of nested rings comprises from two to six nested rings.

4. The selectively height adjustable platform shoe assembly of claim 3, wherein the plurality of nested rings comprises from three to five nested rings.

5. The selectively height adjustable platform shoe assembly of claim 4, wherein the plurality of nested rings comprises four nested rings.

6. The selectively height adjustable platform shoe assembly of claim 1, wherein each nested ring has a height of 1.00 to 4.00 cm.

7. The selectively height adjustable platform shoe assembly of claim 6, wherein each nested ring has a height of 2.00 to 3.00 cm.

8. The selectively height adjustable platform shoe assembly of claim 7, wherein each nested ring has a height of 2.50 to 2.60 cm.

9. The selectively height adjustable platform shoe assembly of claim 1, wherein:

the actuator comprises:

a pump, a reservoir in fluidic communication with the pump and containing hydraulic fluid, a plurality of hydraulic cylinders, and a plurality of hydraulic lines attached to and extending between the pump and the hydraulic cylinders, such that each hydraulic cylinder is in fluidic communication with the pump; and the controller comprises a stem attached to the pump and extending through a sidewall of the sole, wherein the stem is configured for sequentially depressing toward the sidewall for actuating the pump for pumping the hydraulic fluid through the hydraulic lines for extending the nested rings from the recess.

10. The selectively height adjustable platform shoe assembly of claim 9, wherein the plurality of hydraulic cylinders comprising hydraulic cylinders positioned singly at each opposed end of each nested ring.

11. The selectively height adjustable platform shoe assembly of claim 9, wherein each hydraulic cylinder comprises a fixed section and a plurality of movable sections, the plurality of movable sections being numerically equivalent to the plurality of nested rings, each nested ring of the plurality of nested rings being attached to associated movable sections of associated hydraulic cylinders, such that the nested rings are sequentially extended from the recess as the plurality of hydraulic cylinders is extended from the recess.

12. The selectively height adjustable platform shoe assembly of claim 1, further including a panel attached to and extending from a bottom perimeter of the sole, the panel being flexible, such that the panel drapes from the sole to the surface, wherein the panel is configured for shielding the nested rings and the hydraulic cylinders from view by a person proximate to the user.

13. The selectively height adjustable platform shoe assembly of claim 12, wherein the panel comprises fabric.

14. A method of increasing perceived height and actual reach of a user comprising the steps of:

providing a selectively height adjustable platform shoe assembly comprising a pair of articles of footwear, each article of footwear comprising:

a sole, an upper attached to a top perimeter of the sole, such that the upper and the sole define a cavity configured for insertion of a respective foot of a user, a recess extending into a lower face of the sole, the recess extending from proximate to a first end to proximate to a second end of the sole, a plurality of nested rings attached to the sole and positioned in the recess, an actuator attached to the sole, operationally engaged to the plurality of nested rings, and being configured for selectively extending the nested rings from the recess, and a controller attached to the sole and operationally engaged to the actuator, such that the controller is enabled for selectively actuating the actuator for extending the nested rings from the recess, wherein the nested rings are configured for elevating the user from a surface upon which the user is standing or walking;

donning the footwear; and manipulating the controller to actuate the actuator, such that the nested rings are extended from the recess.

15. A selectively height adjustable platform shoe assembly comprising a pair of articles of footwear, each article of footwear comprising:

a sole, an upper attached to a top perimeter of the sole, such that the upper and the sole define a cavity configured for insertion of a respective foot of a user;

a recess extending into a lower face of the sole, the recess extending from proximate to a first end to proximate to a second end of the sole, the recess being substantially elliptical;

a plurality of nested rings attached to the sole and positioned in the recess, the plurality of nested rings comprising four nested rings, each nested ring having a height of 2.50 to 2.60 cm;

an actuator attached to the sole, operationally engaged to the plurality of nested rings, and being configured for selectively extending the nested rings from the recess, the actuator comprising:

a pump, a reservoir in fluidic communication with the pump and containing hydraulic fluid, a plurality of hydraulic cylinders, the plurality of hydraulic cylinders comprising hydraulic cylinders positioned singly at each opposed end of each nested ring, each hydraulic cylinder comprising a fixed section and a plurality of movable sections, the plurality of movable sections being numerically equivalent to the plurality of nested rings, each nested ring of the plurality of nested rings being attached to associated movable sections of associated hydraulic cylinders, such that the nested rings are sequentially extended from the recess as the plurality of hydraulic cylinders is extended from the recess, and a plurality of hydraulic lines attached to and extending between the pump and the hydraulic cylinders, such that each hydraulic cylinder is in fluidic communication with the pump;

a controller attached to the sole and operationally engaged to the actuator, such that the controller is enabled for selectively actuating the actuator for extending the nested rings from the recess, wherein the nested rings are configured for elevating the user from a surface upon which the user is standing or walking, the controller comprising a stem attached to the pump and extending through a sidewall of the sole, wherein the stem is configured for sequentially depressing toward the sidewall for actuating the pump for pumping the hydraulic fluid through the hydraulic lines for extending the nested rings from the recess; and a panel attached to and extending from a bottom perimeter of the sole, the panel being flexible, such that the panel drapes from the sole to the surface, wherein the panel is configured for shielding the nested rings and the hydraulic cylinders from view by a person proximate to the user, the panel comprising fabric.

* * * * *